US011209202B2

(12) United States Patent
Gindele

(10) Patent No.: US 11,209,202 B2
(45) Date of Patent: Dec. 28, 2021

(54) STORAGE CONTAINER FOR STORING ICE CUBES AND FOR PREVENTING OR REVERSING ICE CUBE CLUMPING

(71) Applicant: LIEBHERR-HAUSGERATE OCHSENHAUSEN GMBH, Ochsenhausen (DE)

(72) Inventor: Thomas Gindele, Leutkirch (DE)

(73) Assignee: LIEBHERR-HAUSGERATE OCHSENHAUSEN GMBH, Ochsenhausen (DE)

( * ) Notice: Subject to any disclaimer, the term of this patent is extended or adjusted under 35 U.S.C. 154(b) by 119 days.

(21) Appl. No.: 16/790,773

(22) Filed: Feb. 14, 2020

(65) Prior Publication Data

US 2020/0263914 A1 Aug. 20, 2020

(30) Foreign Application Priority Data

Feb. 15, 2019 (DE) ..... 10 2019 103 904.5

(51) Int. Cl.
*F25C 5/20* (2018.01)

(52) U.S. Cl.
CPC ..... *F25C 5/22* (2018.01); *F25C 2500/08* (2013.01); *F25C 2600/02* (2013.01); *F25C 2600/04* (2013.01)

(58) Field of Classification Search
CPC .... F25C 5/22; F25C 2500/08; F25C 2600/02; F25C 2600/04; F25C 5/182
See application file for complete search history.

(56) References Cited

U.S. PATENT DOCUMENTS

| | | | | |
|---|---|---|---|---|
| 2,247,904 | A * | 7/1941 | Brace | F25D 23/006 62/68 |
| 5,177,980 | A | 1/1993 | Kawamoto et al. | |
| 5,706,660 | A * | 1/1998 | Shank | F25C 5/187 222/56 |
| 5,768,900 | A | 6/1998 | Lee | |
| 2007/0209381 | A1 | 9/2007 | Sugaya et al. | |
| 2013/0192279 | A1 | 8/2013 | McCollough et al. | |
| 2018/0245833 | A1* | 8/2018 | Brewer | F25C 5/187 |
| 2018/0299190 | A1* | 10/2018 | Sakthivel | B67D 1/004 |

FOREIGN PATENT DOCUMENTS

| | | | |
|---|---|---|---|
| JP | 2-272275 | A | 11/1990 |
| JP | 8-94227 | A | 4/1996 |
| KR | 20120004091 | A * | 6/2010 |

(Continued)

OTHER PUBLICATIONS

KR 20120004091A translation.*

(Continued)

*Primary Examiner* — Elizabeth J Martin
(74) *Attorney, Agent, or Firm* — Kilyk & Bowersox, P.L.L.C.

(57) ABSTRACT

A refrigeration device, a freezer device, or a device having both, with a cooled interior space and with a storage container for ice cubes located in this interior space. The device includes an ice cube maker that produces ice cubes. The ice cubes are received in the storage container. A pulse generation is provided, in which one or multiple pulses are applied to the storage container.

14 Claims, 3 Drawing Sheets

(56) References Cited

FOREIGN PATENT DOCUMENTS

Figure 1:
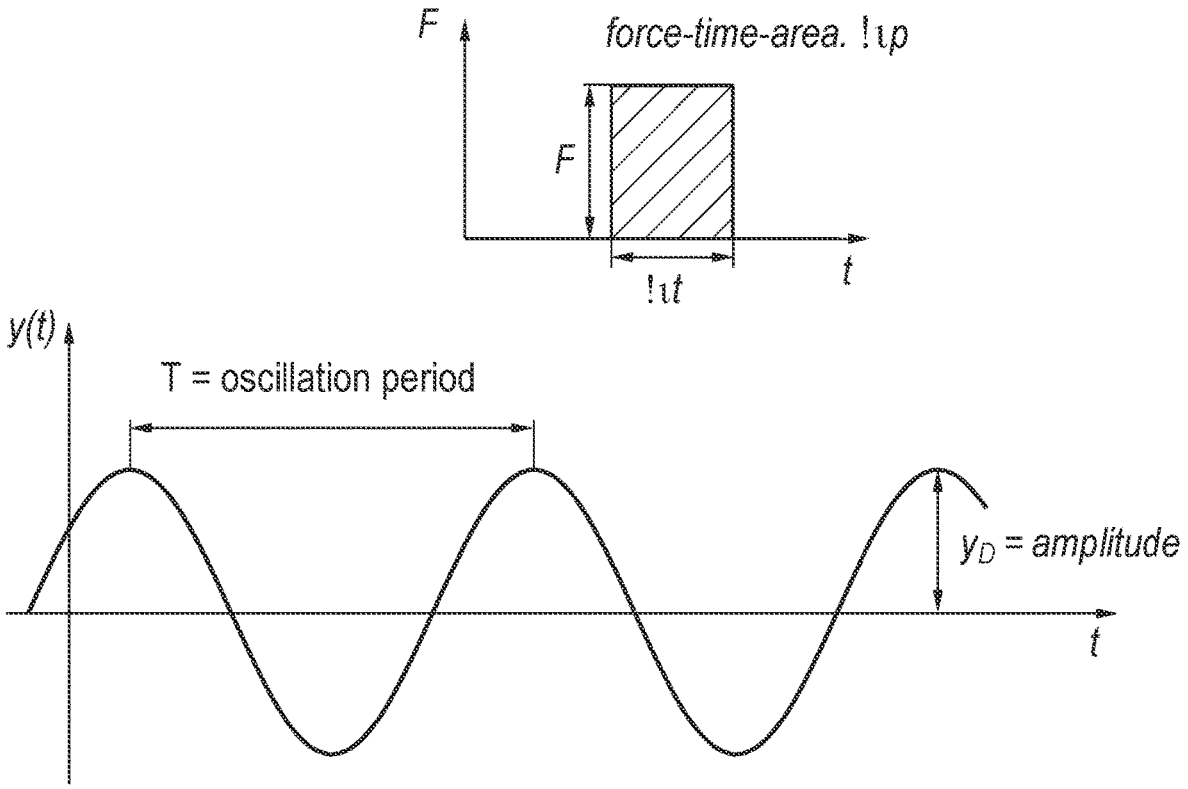

| | | | |
|---|---|---|---|
| KR | 20120043290 | A | 5/2012 |
| WO | 2013178857 | A1 | 12/2013 |

OTHER PUBLICATIONS

Search Report issued in corresponding German Patent Application No. 10 2019 103 904.5 dated Dec. 12, 2019 (6 pages).
Search Report issued in corresponding European Patent Application No. 20 157 363.1 dated Jul. 8, 2020 (7 pages).
Search Report issued in corresponding European Patent Application No. 20 157 363.1 dated May 28, 2021 (5 pages).

* cited by examiner

STORAGE CONTAINER FOR STORING ICE CUBES AND FOR PREVENTING OR REVERSING ICE CUBE CLUMPING

This application claims priority to German Patent Application No. 10 2019 103 904.5, filed Feb. 15, 2019.

The present invention relates to a refrigeration and/or freezer device with a cooled interior space and with a storage container for ice cubes which is located in this interior space, wherein the device preferably comprises an ice cube maker, wherein the ice cubes produced in the ice cube maker are received in the storage container.

However, the invention is not limited to devices with an ice cube maker and also finds application in devices in which ice cubes are stored, but not produced.

Refrigeration and/or freezer devices that comprise an ice cube maker are known from the prior art. The ice cubes produced in the ice cube maker are produced in an ice cube tray and subsequently stored in a storage container until dispensed e.g. through the door of the device at the request of a user.

One problem in a longer storage of the ice cubes consists in that these ice cubes can freeze together so that larger lumps of ice or a compact ice block develops, which can be separated into smaller pieces only with a large application of force. In ice cube makers, the output device of which comprises a screw or spiral coil, there is the option to have these rotated even without the output of ice cubes, in order to separate ice cubes from one another that are frozen together. A solution which is capable of preventing the freezing together of ice cubes is not known for ice cube makers without such an output unit with spiral coils and screws.

It is to be noted that the present invention comprises refrigeration and/or freezer devices with both of the above-mentioned types or other types of ice cube makers, as well as also devices without ice cube makers, because the problem of the freezing-together of ice cubes exists in the storage of ice cubes regardless of the place of production.

Thus, the object of the present invention is to develop a refrigeration and/or freezer device of the above-mentioned type in such a way that a freezing-together of ice cubes is prevented or reduced, or that lumps of already fused ice cubes are separated into smaller pieces again.

This object is achieved by means of a refrigeration and/or freezer device having the features of claim 1. Accordingly, it is provided that the device comprises a pulse generation means which is arranged to apply to the storage container one or multiple pulses. A shock of the ice located in the storage container results from the pulse(s) applied, which leads to a breaking of larger lumps of ice into smaller ice cubes.

It is conceivable to configure the pulse generation means in such a way that a temporally limited pulse is output, or that repeating pulses are output in the form of a vibration or oscillation.

It is conceivable that the pulse generation means comprises a motor which is connected to the storage container via a connection element in such a way that the rotation of the motor leads to a twisting of the storage container, and that the pulse generation means comprises a trigger which is configured to abruptly release the stress generated by the twist.

It is thus conceivable that the connection element is a catch or entrainment member that cooperates with the storage container across a certain rotary angle range so that a twist or built-up of stress in the storage container results. In the event that now the motor is rotated further, an abrupt release of the connection element from the storage container occurs, so that the storage container abruptly assumes his original shape or position again, which leads to the required pulse. The same applies if the connection element is removed by a magnet, etc., for example.

The trigger that leads to the pulse can thus per se comprise the motor, which when rotated further beyond a certain position causes that the storage container is no longer twisted by means of the connection element.

It is also conceivable that the device comprises a closure element, in particular a door, for closing the cooled interior space or a part of this interior space, and that the pulse generation means comprises a lifting device that faces the cooled interior space and that is configured to lift the storage container if the closure element is being closed, wherein it is preferably provided that the lifting device is an inclined plane that engages under the storage container. When the door is being closed, the storage container is lifted, when the door is opened again, the storage container falls back into its original position.

The same applies to a neighboring drawer. When the drawer is being inserted, the storage container is lifted, when the drawer is pulled-out, the storage container falls back into its original position, thereby generating a pulse.

In a further embodiment of the invention, it is provided that the pulse generation means comprises an electromagnet, which cooperates with a mass, wherein a control unit is provided, which is configured to switch the electromagnet on and off. Pulses can be generated by this electromagnet in a targeted manner. It is thus conceivable, for example, that the storage container is lifted by means of the electromagnet and subsequently dropped, or that a mass is attracted by means of the electromagnet against the force of a spring, and accelerated toward the storage container when the electromagnet is switched-off.

A generation of pulses is likewise possible in that a spring mechanism is present, which comprises a spring connected to the closure element in such a way that the spring is tensioned when opening or closing the closure element once or multiple times, and that the spring mechanism is configured to release the spring force for the purpose of pulse generation when the closure element is further opened or closed. Thus, the spring can be tensioned (with each closing or opening of the closure element etc.) across multiple stages, and be released along with a further closing or opening operation (e.g. every fourth closing or opening operation), so that the spring force is released abruptly. This pulse can be used, for example, in order to lift, drop, hit etc. the storage container abruptly.

As described above, the pulse generation means can be or comprise a vibrator, in particular a piezoelectric ceramics, which acts upon the storage container in such a way that vibrations are transmitted to the storage container. These vibrations are applied to the storage container, and thus likewise to the ice located in the container, in order to break the connection between ice cubes.

One possible embodiment is a vibration module on an ice cube maker, which contacts the storage container when the storage container, which is preferably designed as a drawer, is inserted, and which can transmit vibrations on to the container at any time, e.g. multiple days after the last removal of ice cubes, only at night, at regular time intervals, etc.

It is also possible that the ice cube maker contacts the storage container and that the pulse generation means is formed by the motor of the ice cube maker, the vibrations of which are transmitted to the storage container.

In a further embodiment, it is provided that components that produce vibrations during operation of the refrigeration and/or freezer device are coupled with the storage container in such a way that this is also caused to vibrate. These components can be the compressor and/or the ventilator of the refrigeration and/or freezer device, for example.

The refrigeration and/or freezer device can comprise a control, which is configured to activate the pulse generation means at regular or irregular intervals or dependent upon at least one parameter.

For example, the mentioned parameters can be the filling level of the storage container and/or the time span since the last generation of ice cubes and/or since the last removal of ice cubes and/or since the last activation of the pulse generation means.

It is advantageous if a control is provided, by means of which the type of pulse generation and/or pulse intensity can be adjusted. In the event that the user determines that the currently set pulse intensity is not sufficient, the used can increase it accordingly.

The device preferably comprises a user interface, by means of which the control or pulse generation means can be controlled by a user. It is also conceivable that the user interface is provided on an external device, such as a smartphone, which accesses the refrigeration and/or freezer device wirelessly, so that the user can activate, deactivate or adjust the pulse generation means via the smartphone.

The storage container is preferably formed as a drawer.

The drawer can consist of a stiff material. However, it is preferred that the storage container consists of an elastic or flexible material that permits a certain twist, so that a built-up of stress and a subsequent stress relief is possible in a particularly efficient manner.

It is to be noted here that the term "a" does not necessarily relate to exactly one element, even though this is one possible configuration, but can also relate a plurality of elements. Just as well, the use of plural does not exclude the presence of the element in question as a single element and vice versa, use of singular also covers a plurality of the elements in question.

It is further noted that the term "ice cube" does not necessarily imply a certain shape of a piece of ice. This can, but does not have to have the shape of a cube, and any shape is conceivable.

Further details and advantages of the invention are explained in detail by means of an exemplary embodiment illustrated in the drawings.

Figure 2:
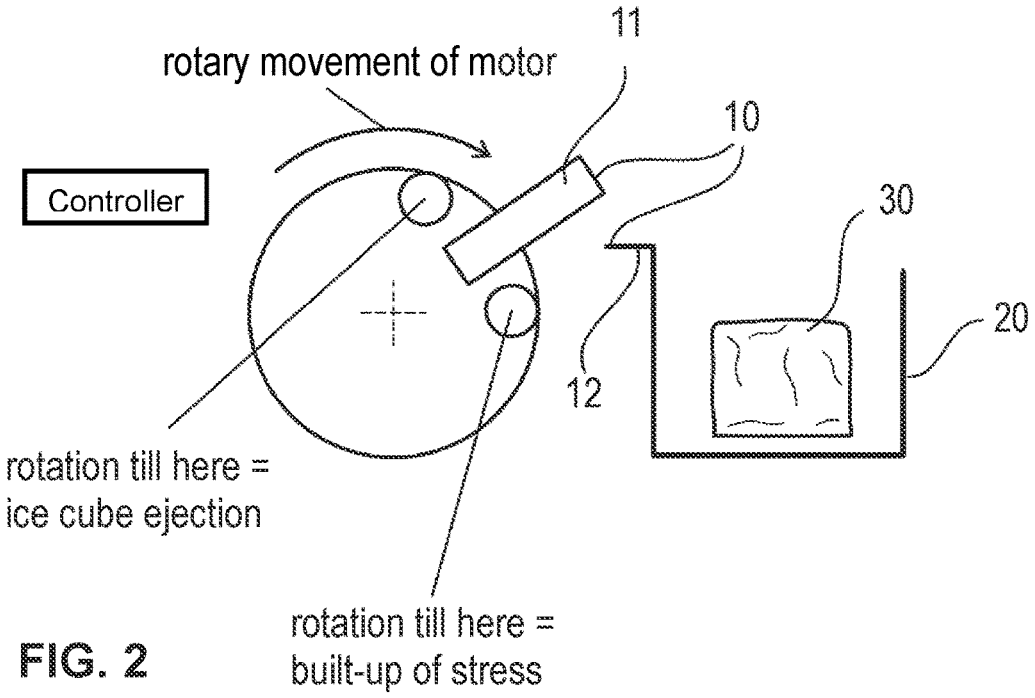
Figure 3:
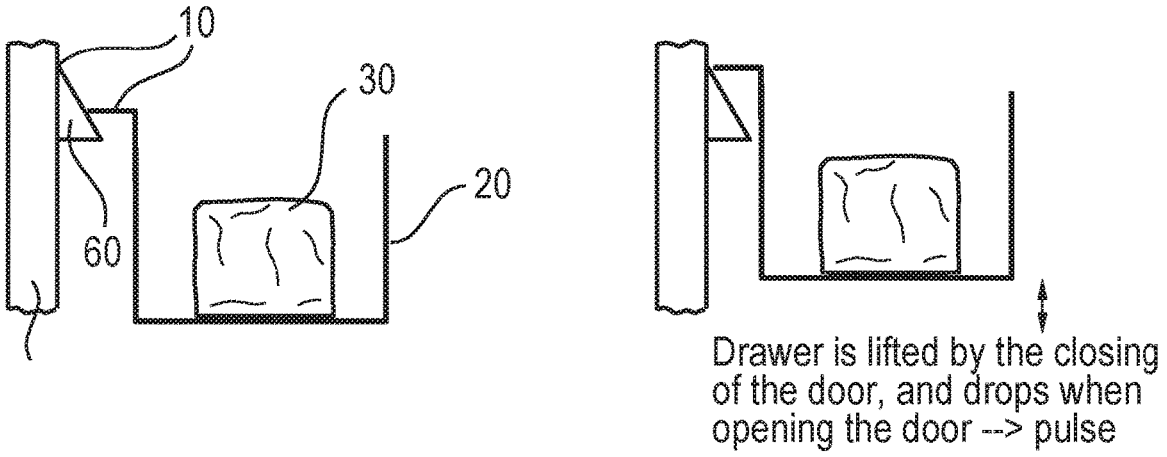
Figure 4:
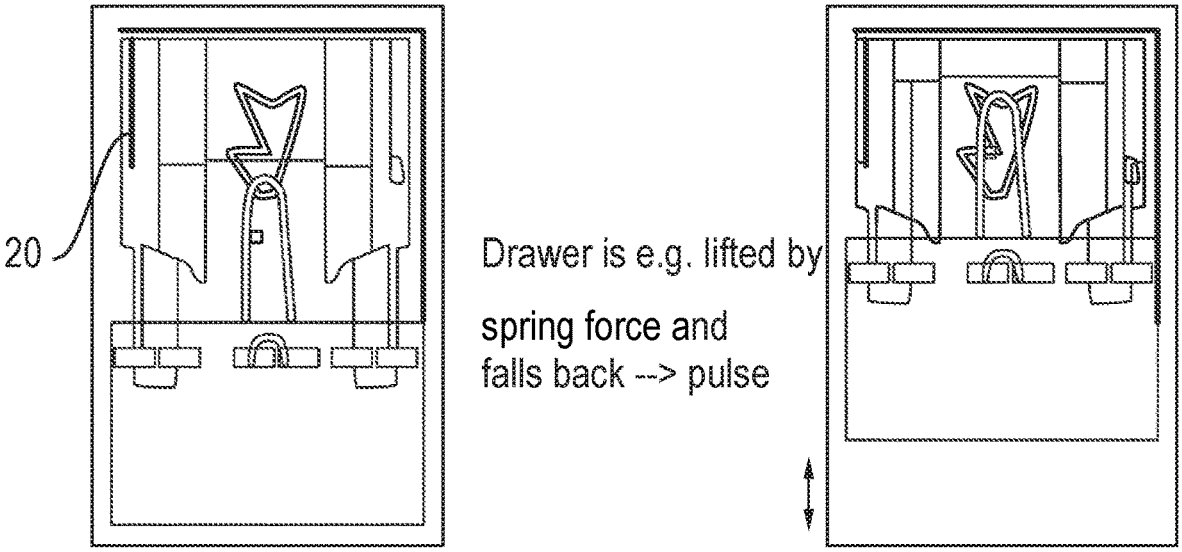
Figure 5:
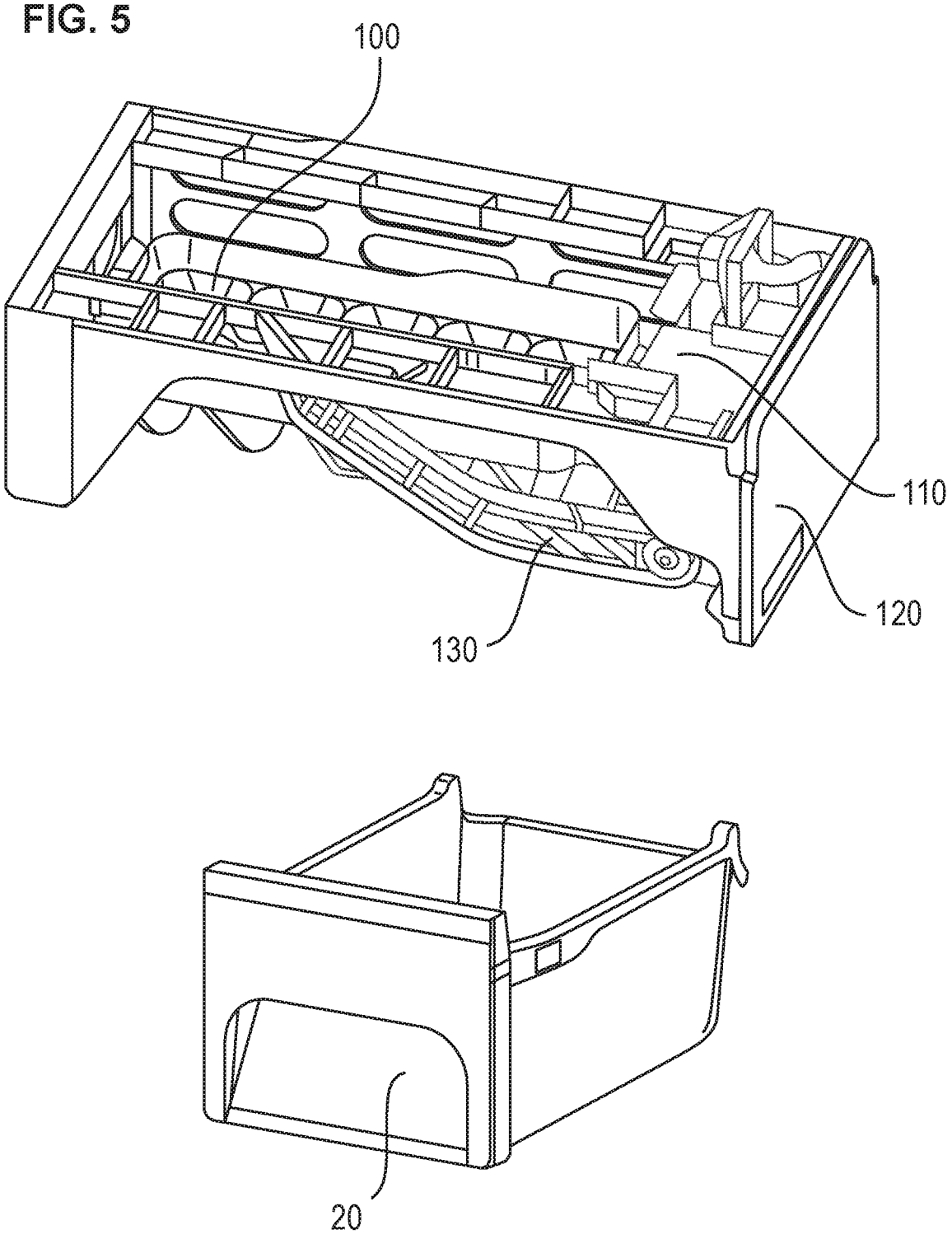

The drawings show in:

FIG. 1: schematic variants of pulse generation,

FIG. 2: a first embodiment of the pulse generation means with storage container, FIG. 3: a second embodiment of the pulse generation means with storage container, FIG. 4: a third embodiment of the pulse generation means with storage container, and FIG. 5: a perspective view of an ice cube manner with storage container.

In the exemplary embodiment described in the following, an ice cube maker 120 is arranged in the cooled interior space of the device in accordance with FIG. 5, which ice cube maker comprises an ice cube tray 100, into which the water to be frozen is filled, as well as a motor 110 for ejecting the ice cubes through a rotation of the ice cube tray 100. Reference character 130 relates to a filling level measuring device for determining the filling level of the ice cubes in the storage container 120 arranged below the ice cube maker 120, which is generally preferably configured as a drawer.

In order to prevent ice cubes in the storage container 120 from freezing together, or at least minimize this, according to the invention provision is made for a pulse generation means which is arranged and configured to apply one or multiple pulses to the storage container.

According to FIG. 1 (upper drawing), it is possible to apply a strong pulse, then not to apply a pulse over a time span, and subsequently optionally output another pulse, etc. In this illustration, the force acting on the storage contained is plotted against time.

According to another approach according to FIG. 1 (lower drawing), the introduction of multiple weaker pulses in the form of a vibration is conceivable. In this representation, the amplitude of the vibration is plotted against time.

FIG. 2 shows an exemplary embodiment with a controller and a motor 1 that generates a rotary movement around a rotary axis standing vertically with respect to the drawing plane. The motor 1 serves to rotate and twist the ice cube tray 100, whereby the ice cubes 30 fall into the storage container 20.

Reference character 10 generally relates to a means for building-up stress, which in this example is formed by the catch 11 and by a region of the storage container 20 that cooperates with the catch.

The catch 11, which rotates along with the motor, cooperates with the peripheral region 12 of the storage container 20, namely in such a way that the storage container is put into a stressed state by the rotation. The built-up of stress occurs until the point "rotation till here=build-up of stress" shown in FIG. 2. If the motor 1 is rotated further, contact between the catch 11 and the storage container ends abruptly, which causes the required pulse. The same applies if the catch is suddenly removed.

This release can occur with the rotation end of the ice cube tray 100, or prior to or after the ejection of the ice cubes into the storage container 20. The mentioned pulse can occur at every ejection, or at regular intervals, or after the filling level measuring device 130 registers that no ice cubes have been removed.

The likewise shown position "rotation till here=ejection of ice cubes" indicates the position of the motor where an ejection of the ice cubes from the ice cube tray 100 into the storage container 20 occurs.

FIG. 3 shows an exemplary embodiment, in which a wedge or another oblique plane 60 is arranged at the inner side of the door 50, which cooperates with the storage container 20 in such a way that the storage container is lifted when closing the door. This can occur through the door, or also through another moveable element, e.g. through a drawer neighboring the storage container 20, etc.

When opening the door, the storage container 20 falls back into its initial position, so that a corresponding pulse is generated.

FIG. 4 shows an embodiment, in which a spring mechanism is tensioned in multiple stages. It is thus conceivable that the spring mechanism, which can include one or multiple springs, is tensioned further in a stepwise manner, and the storage container is lifted thereby every time the door, or another closing element of the device, is opened or closed, or a drawer etc. is opened or closed. At a certain count, e.g. closing or opening the door etc. for the third time, the spring mechanism is relaxed abruptly, which results in that the storage container 20 falls back into its original position so that a pulse is triggered as well.

The invention claimed is:

1. A device comprising a refrigeration device, a freezer device, or both, the device comprising a cooled interior space, and a storage container for ice cubes located in the interior space, wherein the device comprises an ice cube maker, wherein the ice cubes produced in the ice cube maker are received in the storage container, wherein a pulse generation means is present, which is arranged to apply one or more pulses to the storage container, and the pulse generation means comprises a motor connected to the storage container via a connection element, the motor is configured to rotate the connection element to engage with the storage container, which results in a twisting or other stress generation of the storage container, and the pulse generation means comprises a trigger configured to abruptly release the connecting element from the storage container, thereby releasing the twisting or other stress generation.

2. The device according to claim 1, wherein the pulse generation means is further configured to emit a temporally-limited pulse or pulses in the form of a vibration.

3. The device according to claim 1, wherein the trigger is configured to cause the motor to keep rotating in such a way that the connection element no longer connects the motor to the storage container, or is configured in such a way to remove the connection element.

4. The device according to claim 1, wherein the device comprises a closure element for closing the cooled interior space or a part thereof, and that the pulse generation means further comprises a lifting device, which faces the cooled interior space and which is configured to lift the storage container when the closure element is being closed, wherein it is provided that the lifting device is an oblique plane that engages under the storage container.

5. The device according to claim 1, wherein the pulse generation means further comprises an electromagnet which cooperates with the storage container, wherein a controller is provided, which is configured to switch the electromagnet on and subsequently off.

6. The device according to claim 1, wherein a spring mechanism is present, which comprises a spring connected with a closure element in such a way that the spring is tensioned when opening or closing the closure element once or multiple times, and that the spring mechanism is configured to release the spring force for the purpose of pulse generation upon a further opening or closing of the closure element.

7. The device according to claim 1, wherein the pulse generation means further comprises a vibrator, which acts upon the storage container in such a way that vibrations are transmitted on to this container.

8. The device according to claim 1, wherein the motor is further configured to cause the storage container to vibrate, wherein it is provided that the motor is the motor of the ice cube maker.

9. The device according to claim 1, wherein components that produce vibrations during operation are coupled to the storage container in such a way that the container is also induced to vibrate.

10. The device according to claim 9, wherein the components comprise or are a compressor and/or a ventilator.

11. The device according to claim 1, wherein a controller is provided, which is configured to activate the pulse generation means at regular or irregular intervals or dependent upon at least one parameter.

12. The device according to claim 11, wherein the parameter is the filling level of the storage container and/or the time span since the last production of ice cubes and/or since the last removal of ice cubes and/or since the last activation of the pulse generation means.

13. The device according to claim 11, wherein the controller is configured to adjust the type of pulse generation and/or the pulse intensity.

14. The device according to claim 11, further comprising a user interface for controlling the controller by a user.

* * * * *